US005291770A

United States Patent [19]

Koujin et al.

[11] Patent Number: 5,291,770

[45] Date of Patent: Mar. 8, 1994

[54] ROLL CROSSING APPARATUS FOR CROSS-ROLLING MILL

[75] Inventors: Hisayoshi Koujin; Kazuhiko Horie; Yutaka Matsuda; Tadashi Hiura; Yoshiki Mito, all of Hiroshima, Japan

[73] Assignee: Mitsubishi Jukogyo Kabushiki Kaisha, Tokyo, Japan

[21] Appl. No.: 922,464

[22] Filed: Jul. 30, 1992

[30] Foreign Application Priority Data

Jul. 30, 1991 [JP] Japan ..... 3-190358
Jun. 30, 1992 [JP] Japan ..... 4-172184

[51] Int. Cl.[5] ..... B21B 13/02; B21B 31/30

[52] U.S. Cl. ..... 72/237; 72/241.2; 72/244

[58] Field of Search ..... 72/237, 241.2, 241.4, 72/244

[56] References Cited

FOREIGN PATENT DOCUMENTS 55-45583 3/1980 Japan .
0131005 10/1981 Japan ..... 72/241.4
0004307 1/1982 Japan ..... 72/241.2
0085306 5/1984 Japan ..... 72/241.2
60-118310 6/1985 Japan .
60-29562 7/1985 Japan .
0054121 11/1985 Japan ..... 72/241.2
1315059 6/1987 U.S.S.R. ..... 72/244
1440572 11/1988 U.S.S.R. ..... 72/244
2178988 2/1987 United Kingdom .

*Primary Examiner*—David Jones
*Assistant Examiner*—Thomas C. Schoeffler
*Attorney, Agent, or Firm*—Wenderoth, Lind & Ponack

[57] ABSTRACT

A cross-rolling mill has upper and lower work rolls which can be made to cross one another together with their respective backup rolls by moving upper and lower roll chocks in pass lines opposite to each other with upper and lower cross heads. Upper and lower gradient portions are formed at opposite inclinations at side faces of the upper cross head and the lower cross head, respectively. Wedges having upper and lower oppositely inclined surfaces slidably engage the gradient portions of the upper and lower cross heads. The upper and lower cross heads can thus be moved in opposite pass line direction by moving the inclined surfaces of the wedges upward and downward.

18 Claims, 9 Drawing Sheets

ROLL CROSSING APPARATUS FOR CROSS-ROLLING MILL

BACKGROUND OF THE INVENTION

1. Field of the Invention

The present invention relates to a roll crossing apparatus for causing the upper and lower rolling rolls of a cross-rolling mill to cross each other in horizontal directions.

2. Description of the Prior Art

FIG. 8 is a side elevation view of an essential portion of a cross-rolling mill of the prior art, and FIG. 9 is a perspective view of a roll crossing apparatus of the mill of FIG. 8.

As shown, shafts 35 are rotated, as better seen from FIG. 9, through individual bevel gears 34 by individual motors 51. Then, screw shafts 32 threaded to nuts 33 are rotated through individual worm reduction gears 31. Thus, an upper cross head 29 and a lower cross head 30 fitted in guides 36 are moved in opposite pass line directions.

As these upper and lower cross heads 29 and 30 move, an upper work roll chock 25 and an upper backup roll chock 27, and a lower work roll chock 26 and a lower backup roll chock 28 revolve in opposite directions about the central portions of the upper and lower work rolls 21 and 22, as taken in the roll axis directions, to cause the upper work roll 21 and an upper backup roll 23, and the lower work roll 22 and a lower backup roll 24 to cross each other.

In the rolling operation, a rolled sheet S has its shape adjusted by regulating the cross angle and by bending the upper and lower work rolls 21 and 22.

The apparatus described above has the following drawbacks.

(1) Since the upper and lower cross heads 29 and 30 having considerable lengths are individually supported at two points along their lengths by two of the screw shafts 32, they typically have large thicknesses in the pass line directions. This makes it necessary to provide a wide window (i.e., the spacing between the inner side surfaces) for the housing 20 or deep grooves which are formed in the inner side surfaces of the housing 20 to accommodate the upper and lower cross heads 29 and 30. Unless the housing 20 is to have low strength and rigidity, it is necessary to further enlarge the size of the housing.

(2) Since the loads to be borne by the upper and lower cross heads 29 and 30 are applied directly to the screw shafts 32 and the nuts 33, these shafts 32 and nuts 33 have to be large which thus requires that the roll crossing drive train elements, such as the worm reduction gears 31, to be large.

(3) Each stand has to be equipped with as many as sixteen sets of screw shafts 32, nuts 33 and worm reduction gears 31; therefore, the apparatus is accordingly complicated and expensive.

(4) When an existing parallel rolling mill is to be reformed into a cross-rolling mill having a high ability to control the sheet shapes, the housing 20 has to be remarkably worked.

SUMMARY OF THE INVENTION

It is, therefore, an object of the present invention to provide a roll crossing apparatus for a cross-rolling mill, which can be small and manufactured at a reasonable cost.

Another object of the present invention is to provide a roll crossing apparatus of a cross-rolling mill which can be easily retrofitted to an existing parallel rolling mill.

In order to achieve the above-specified objects, the present invention has the following structure.

(1) In a cross-rolling mill of the type in which upper and lower work rolls are caused to cross together with their respective backup rolls by moving upper and lower roll chocks in pass lines opposite to each other with upper and lower cross heads interposed between the upper and lower chocks and the inner side surfaces of a housing: upper and lower gradient portions are inclined in opposite directions at the sides of the upper cross head and the lower cross head, respectively, facing the inner side surfaces of the housing; and upper and lower wedges are interposed between the upper and lower cross heads and the inner side surfaces of the housing and have upper and lower oppositely inclined surfaces which slidingly engage the gradient portions of the upper and lower cross heads.

Moreover, the roll crossing apparatus having the structure described above may be disposed at only one of the working side and the drive side of the rolling mill, and the rolls may be supported at fixed points at the other side.

(2) In a cross-rolling mill of the type in which upper and lower rolls are caused to cross by moving upper and lower roll chocks in pass lines opposite to each other with upper and lower cross heads: guide blocks are fixed on outer surfaces of the housing; upper and lower gradient portions are formed with opposite inclinations at sides of the upper cross head and the lower cross head, respectively, opposite the roll chocks; and upper and lower edges are interposed between the upper and lower cross heads and the guide blocks and have upper and lower inclined surfaces slidably engaging the gradient portions of the upper and lower cross heads.

Moreover, the roll crossing apparatus having the structure described above may be disposed at only one of the working side and the drive side of the rolling mill, and the rolls may be supported at fixed points at the other side.

With the roll crossing apparatus having the above-specified structures (1) and (2), the upper and lower rolls can be made to cross each other at a desired angle in the following manners (1) and (2).

(1) During the rolling operation of the rolling mill, the upper and lower rolls are caused to cross at a desired angle by moving the individual wedges upward or downward so that their inclined surfaces sliding on the gradient portions of the upper and lower cross heads move both the upper and lower cross heads in the opposite pass lines directions.

Vertically integrated wedges may be adopted by which the upper and lower cross heads are simultaneously moved in the opposite pass line directions, during the rolling operation of the rolling mill, by moving integrated upper and lower portions of the wedges upward or downward. Inclined surfaces of these portions slide on the gradient portions of the upper and lower cross heads, respectively.

(2) During the rolling operation of the rolling mill, the upper and lower rolls are caused to cross each other at a desired cross angle by moving the individual wedges upward and downward, while being guided by the guide blocks fixed on the outer surfaces of the housing, so that their inclined surfaces sliding on the gradient portions of the upper and lower cross heads move the upper and lower cross heads in the opposite pass line directions thereby revolving the upper and lower mill chocks in opposite directions.

Again, vertically integrated wedges may be adopted as in the aforementioned case (1), so that the upper and lower cross heads are moved simultaneously in opposite pass line directions as the result of the vertical movements of the integrated wedges.

DETAILED DESCRIPTION OF THE PREFERRED EMBODIMENTS

Figure 1:
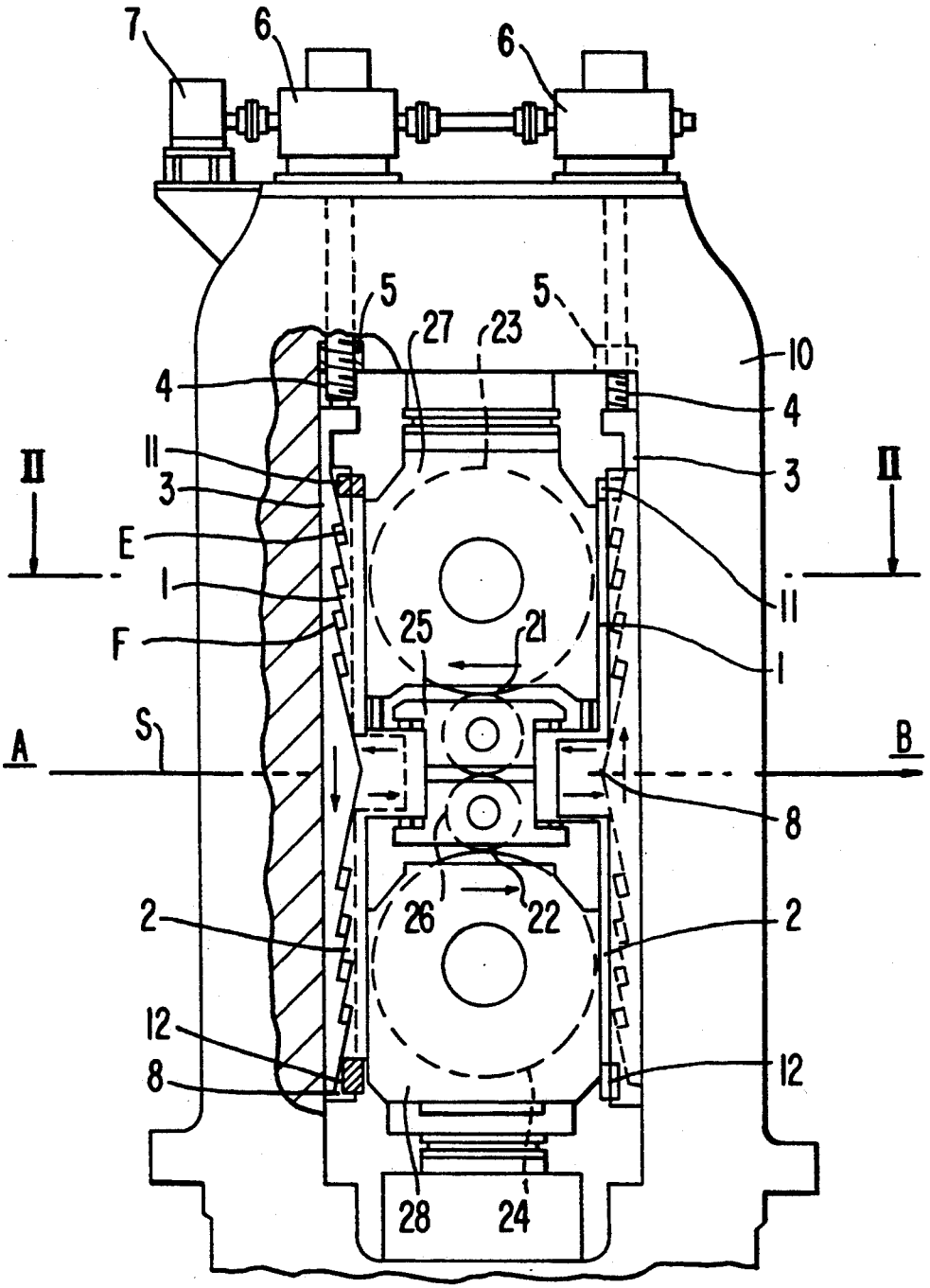
FIG. 1 is a side elevation view of an essential portion of a cross-rolling mill which is equipped with one embodiment of a roll crossing apparatus according to the present invention.
Figure 2:
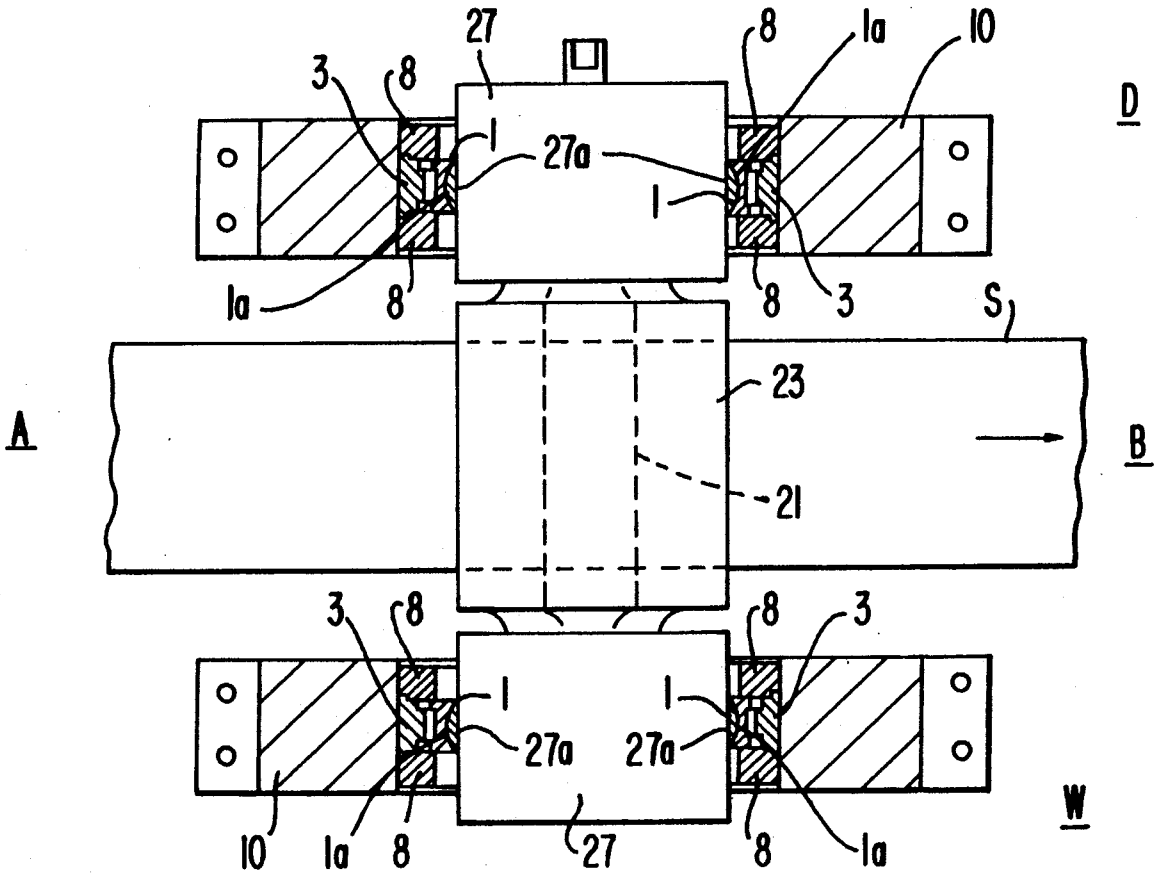
FIG. 2 is a sectional view taken along line II—II of FIG. 1.

In FIGS. 1 and 2, reference numerals 1 and 2 designate upper and lower cross heads, respectively, which have outer side surfaces forming a number of steps referred to collectively as gradient portions E. These gradient portions E are inclined vertically in opposite directions at each side of the upper and lower cross heads 1 and 2. These cross heads 1 and 2 slide on each other in pass line directions. Moreover, the cross heads 1 and 2 further slide on the two side surfaces of an upper work roll chock 25 and an upper backup roll chock 27, and a lower work roll chock 26 and a lower backup roll chock 28, respectively, but are prevented from moving vertically by upper and lower guides 11 and 12.

Each of the roll chocks has liners, e.g. lines 27*a* in FIG. 2, on opposite sides thereof. The liners have an outer cylindrical surface as shown in the figure. On the other hand, each of the cross heads has a cylindrical surface, e.g. surface 1*a*, at an inner side thereof and which surface 1*a* is complementary to and in face-to-face engagement with the cylindrical surface of a liner.

Numeral 3 designates vertically integrated wedges which have inclined surfaces F sliding on the gradient portions E of the upper and lower cross heads 1 and 2. The wedges 3 are interposed between the inner side surfaces of a housing 10 and the upper and lower cross heads 1 and 2 and are guided by side guides 8. Moreover, the wedges 3 have their upper ends connected to the screw shafts 4 of worm reduction gears 6, which are threaded in nuts 5 embedded in the housing 10. Numeral 7 designates a drive motor for the two worm reduction gears 6.

Numerals 21, 22, 23, 24 designate an upper work roll, a lower work roll, an upper backup roll and a lower backup roll, respectively, which are supported like the prior art by the upper and lower work roll chocks 25 and 26 and the upper and lower backup roll chocks 27 and 28.

The operation of the apparatus will be described in the following.

The individual screw shafts 4 are rotated through the corresponding worm reduction gears 6 by the motor 7. By these rotations, the wedges 3 at the entrance A of a working side W and at the exist B of a drive side D are moved downward, and the wedges 3 at the exit B of the working side W and at the entrance A of the drive side D are moved upward to slide incline surfaces F along the gradient portions E of the upper and lower cross heads 1 and 2 so that these cross heads 1 and 2 are moved in the pass line directions opposite to each other.

As a result of the movements of the upper and lower cross heads 1 and 2, the upper work roll chock 25 and the upper backup roll chock 27, and the lower work roll chock 26 and the lower backup roll chock 28 rotate about the axially central portions of the upper and lower work rolls 21 and 22 in opposite directions to cause the upper work roll 21 and the upper backup roll 23 to cross the lower work roll 22 and the lower backup roll 24.

In the rolling operation, the shape of a rolled sheet S is adjusted by regulating that cross angle and by bending the upper and lower work rolls 21 and 22.

Incidentally, the drive source used for lifting the wedges 3 may be a hydraulic cylinder.

According to the present invention, the loads to be borne by the upper and lower cross heads 1 and 2 are transmitted to the worm reduction gears 6 through the wedges 3. Thus, the worm reduction gears 6, the screw shafts 4 and the nuts 5 can be small.

In the present invention, moreover, the number of sets of the worm reduction gears 6 can be 4 for each stand.

The roll crossing apparatus of the cross-rolling mill thus far described has the following effects because it is provided with the wedges having the inclined portions F and the upper and lower cross heads having the gradient portions E engaged with the inclined portion F.

(1) Since the loads to be borne by the upper and lower cross heads are dispersed and supported by the inner side surfaces of the housing through the wedges, the spacing between the roll chocks and the inner side surfaces of the housing may be small. Thus, the width of the window (i.e., the spacing between the two inner side surfaces) of the housing may be narrow. As a result, the housing can have their upper cross beams so as to be compact.

(2) Since the loads to be borne by the upper and lower cross heads are transmitted through the wedges to the drive train of the roll crossing apparatus, the drive train can have small parts.

(3) Since the upper and lower cross heads have gradient portions E whereas the upper and lower wedges have the opposing inclined portions F, the upper and lower rolls can be prevented from any operational displacement by moving the wedges upward and downward together with a set of drive trains so that the setting accuracy of the roll crossing position is stable and high.

Next, another embodiment will be described with reference to FIGS. 3 and 4. Incidentally, the parts shown in FIGS. 3 and 4 and similar to those shown in FIGS. 1 and 2 will be designated by identical reference numerals.

Figure 3:
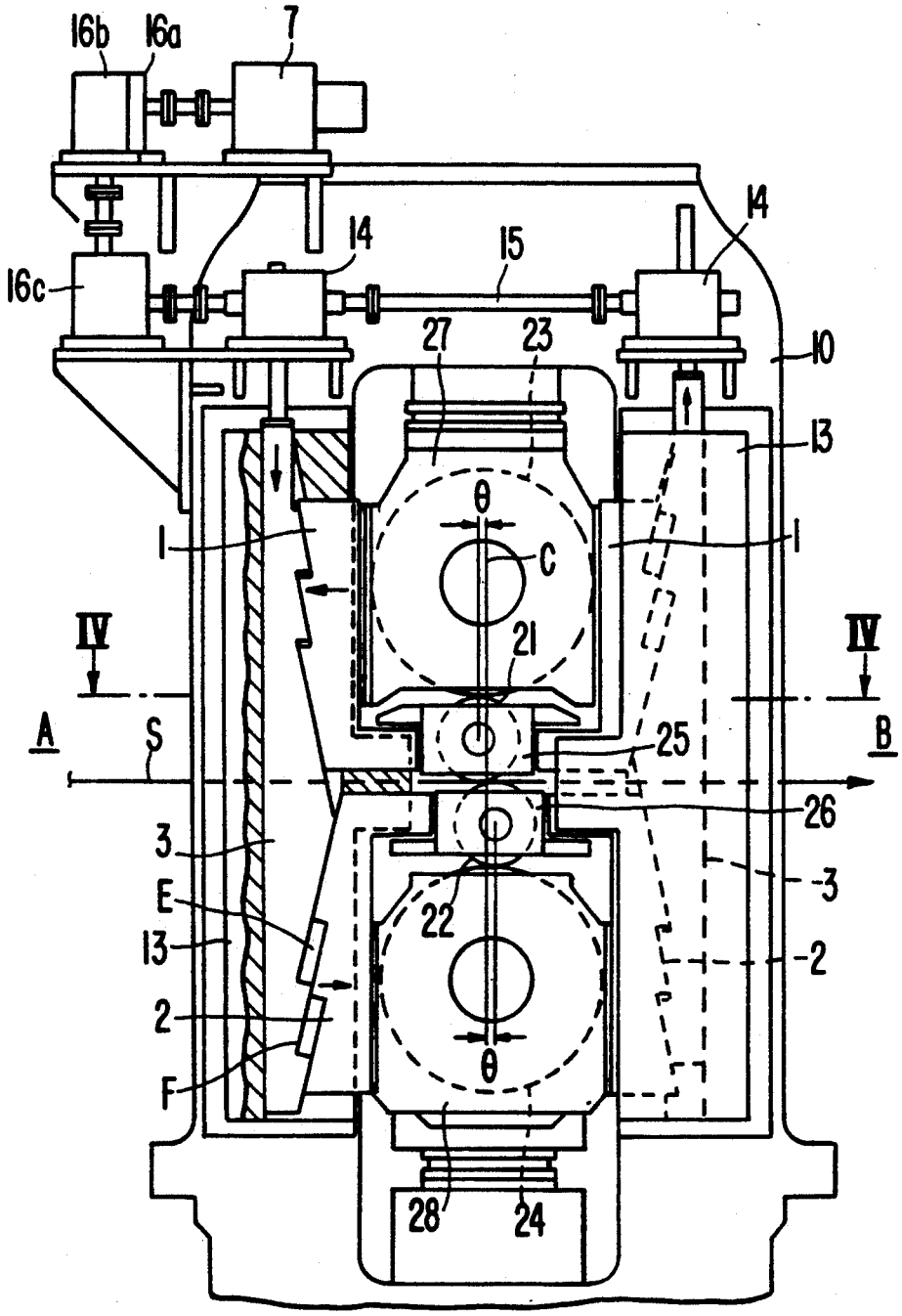
FIG. 3 is a side elevation view of an essential portion of a cross-rolling mill which is equipped with a second embodiment of a roll crossing apparatus according to the present invention.
Figure 4:
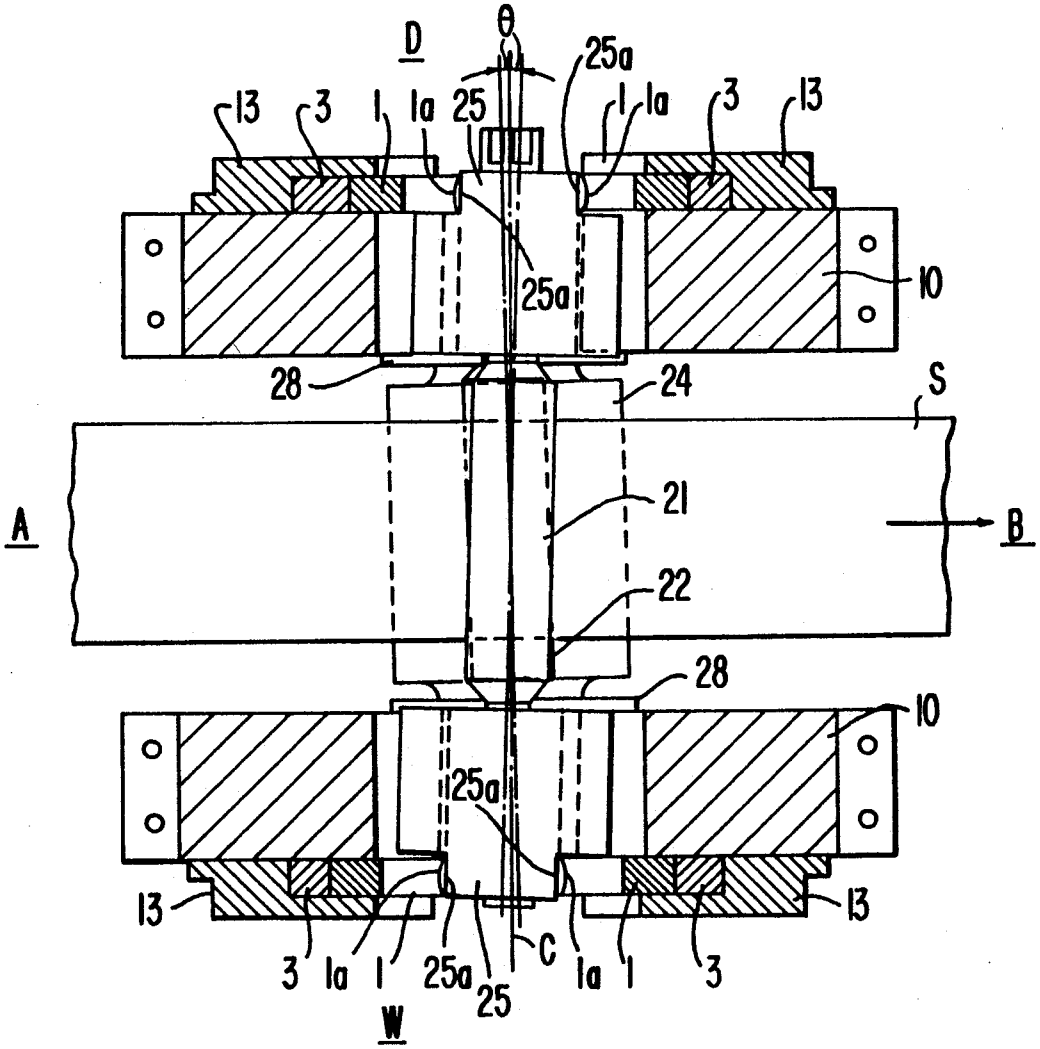
FIG. 4 is a sectional view taken along line IV—IV of FIG. 3.

In FIGS. 3 and 4, reference numerals 1 and 2 designate upper and lower cross heads, respectively, which have outer side surfaces (i.e., the side surfaces facing away from the roll chocks) forming a number of steps referred to collectively as gradient portions E. These gradient portions E are inclined vertically in opposite directions at each side of the upper and lower cross heads 1 and 2. These upper and lower cross heads 1 and 2 can move in opposite pass line directions, respectively, at upper and lower portions of guide blocks 13 which are fixed to the outer side surfaces of the entrance A and the exit B of the drive side D and the working side W of a housing 10. An upper work roll chock 25 and an upper backup roll chock 27, and a lower work roll chock 26 and a lower backup roll chock 28 engage the upper and lower cross heads 1 and 2, respectively, so as to move together with the upper and lower cross heads 1 and 2, respectively.

The roll chocks are provided with liners having cylindrical surfaces in face-to-face engagement with cylindrical surfaces defined by the inner sides of the cross heads, similar to the first embodiment and as shown in FIG. 4. Reference numeral 25*a* designates such liners while 1*a* designates cylindrical surfaces.

Numeral 3 designates vertically integrated wedges, which have inclined portions F sliding on the gradient portions E of the upper and lower cross heads 1 and 2. These wedges 3 are interposed between the upper and lower cross heads 1 and 2 and the guide blocks 13 and have their upper ends connected to screw jacks 14 which are fixed at the drive side D and the working side W of the housing 10.

The screw jacks 14 at the entrance A and the exit B of each side of the housing 10 are connected through a shaft 15. Moreover, the respective screw jack 14 at the entrance A of the drive side D and of the working side W is connected to one motor 7 through upper and lower bevel gear sets 16*b* and 16*c*, and a bevel gear 16*a* which is arranged inbetween two of the bevel gears of the upper bevel gear set 16*b*.

Numerals 21, 22, 23 and 24 designate an upper work roll, a lower work roll, an upper backup roll and a lower backup roll, respectively, which are supported by the upper and lower work roll chocks 25 and 26 and the upper and lower backup roll chocks 27 and 28, respectively.

The operation of the embodiment above will be described in the following.

The upper and lower cross heads 1 and 2 are moved in the opposite pass line directions by driving the individual screw jacks 14 with the motor 7 through the individual bevel gears 16*a*, 16*b* and 16*c* to move the wedges at the entrance A of the working side W and at the exit B of the drive side D downward and the wedges 3 at the exit B of the working side W and at the entrance A of the drive side D upward thereby sliding inclined portions F on the gradient portions E of the upper and lower cross heads 1 and 2.

As a result of the movements of those upper and lower cross heads 1 and 2, the upper work roll chock 25 and the upper backup roll chock 27, and the lower work roll chock 26 and the lower backup roll chock 28 are rotated in opposite directions about the axial center portions of the upper and lower work rolls 21 and 22. Thus, the upper work roll 21 and the upper backup roll 23, and the lower work roll 22 and the lower backup roll 24 are caused to cross at a desired cross angle $\theta$ from the center C of the rolling mill.

In the rolling operation, the widthwise shape of the rolled sheet S is adjusted by regulating that cross angle $\theta$ and by bending the upper and lower work rolls 21 and 22.

Incidentally, the drive source used for moving the wedges 3 upward and downward may be a hydraulic cylinder.

The present embodiment has been described as applied to a cross-rolling mill in which the upper work roll 21 and the upper backup roll 23, and the lower work roll 22 and the lower backup roll 24 are to cross. However, the present invention can also be applied to a work roll crossing mill in which only the upper and lower work rolls 21 and 22 are to cross as shown in FIG. 5.

Figure 5:
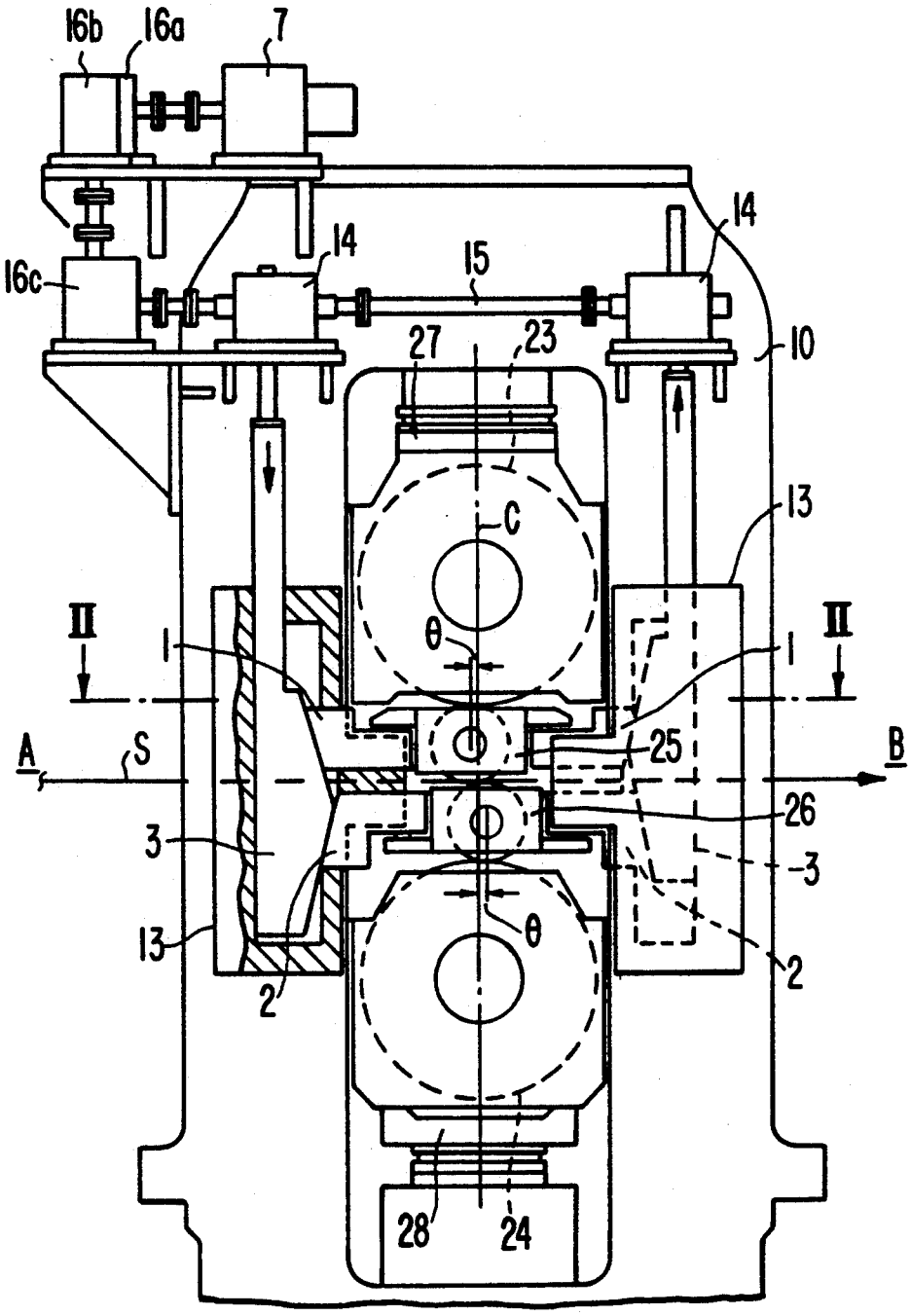
FIG. 5 is a side elevation view similar to that of FIG. 3 but shows an embodiment in which only work rolls are caused to cross each other by wedges arranged on the outer sides of a housing.

According to the embodiment shown in FIGS. 3 to 5, a respective bevel gear 16*a* is arranged between two bevel gears of each set 16*b* provided on the top surface of the housing 10 at the drive side D and the working side W. The bevel gear 16*a* is connected through a shaft to the single motor 7. This roll crossing apparatus is operated by the single motor 7 and the motor 7 can be easily controlled. At the same time, the upper and lower cross heads 1 and 2 at the drive side D and the working side W can be moved in complete synchronism so that the upper and lower work rolls and backup rolls 21, 22, 23 and 24 can cross smoothly and accurately.

Moreover, the following effects can be achieved by the embodiment of the roll crossing apparatus of the cross-rolling mill shown in FIGS. 3 to 5.

(1) Since the wedges are moved upward and downward to move the upper and lower cross heads in the opposite pass line directions and thereby cause the upper and lower work rolls to cross each other, the loads to be borne by the upper and lower cross heads are vertically dispersed through the wedges and supported by the guide blocks. Thus, these guide blocks can be small.

(2) Since the upper and lower wedges are integrally moved upward and downward, the upper and lower cross heads can be moved in complete synchronism so that the upper and lower rolls can accurately cross each other.

(3) Since the wedges and the guide blocks for guiding the upper and lower cross heads are mounted on outer surfaces of the housing, an existing parallel rolling mill can be easily reformed into the cross-rolling mill of the present invention which is highly capable of controlling the shape of the rolled sheet.

Figure 6:
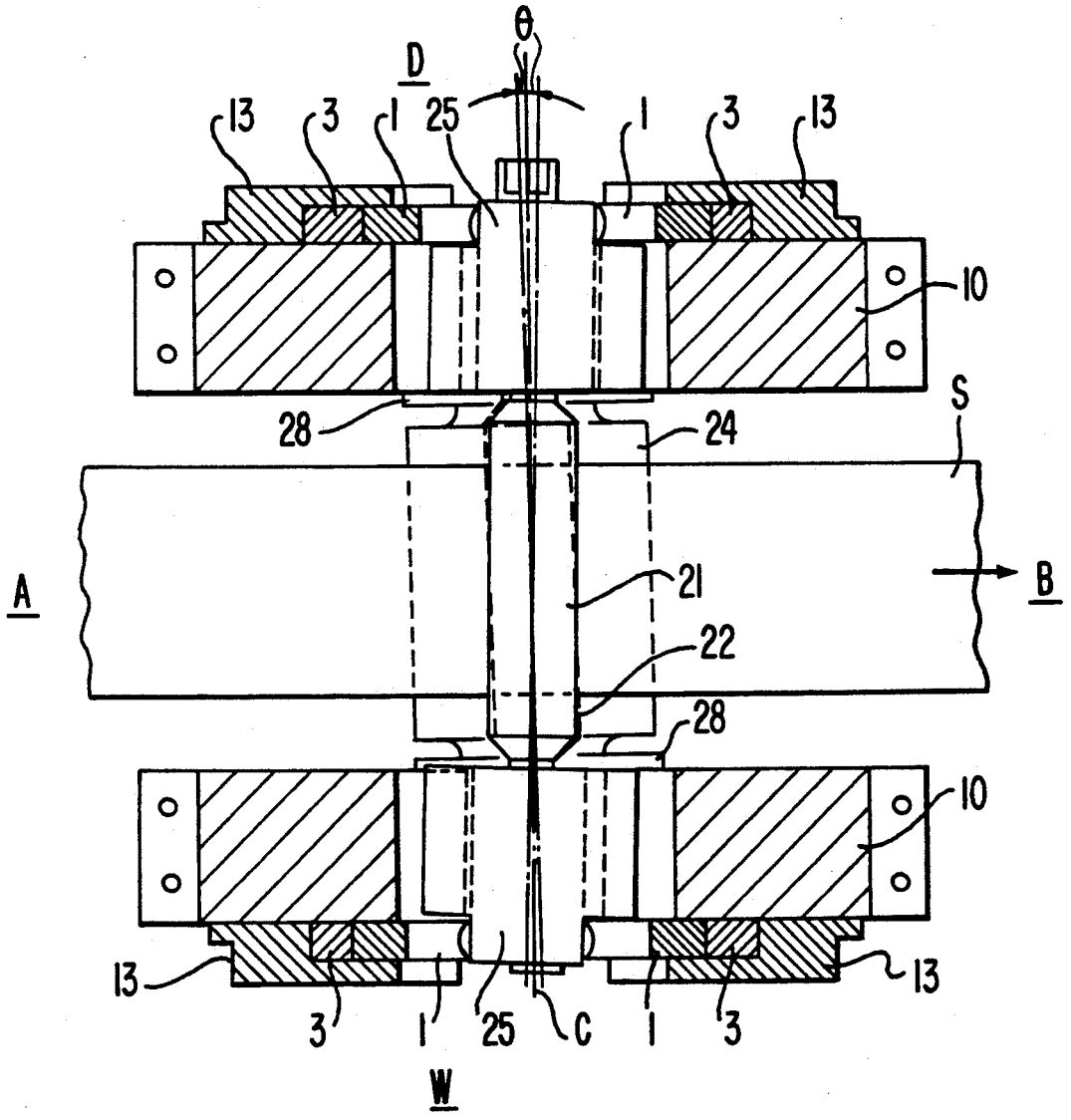
FIG. 6 is a sectional view similar to that of FIG. 4 but shows an embodiment in which work rolls are moved only at a drive side D and are supported at a fixed point at a working side W.

Incidentally, in the embodiments thus far described, the individual rolls are moved at both the drive side D and the working side W in opposite directions toward the entrance A and the exit B of the housing. As shown in FIG. 6, however, the work rolls 21 and 22 may be moved only at the drive side D in opposite directions toward the entrance A and the exit B and may be supported at fixed points at the working side W.

Figure 7B:
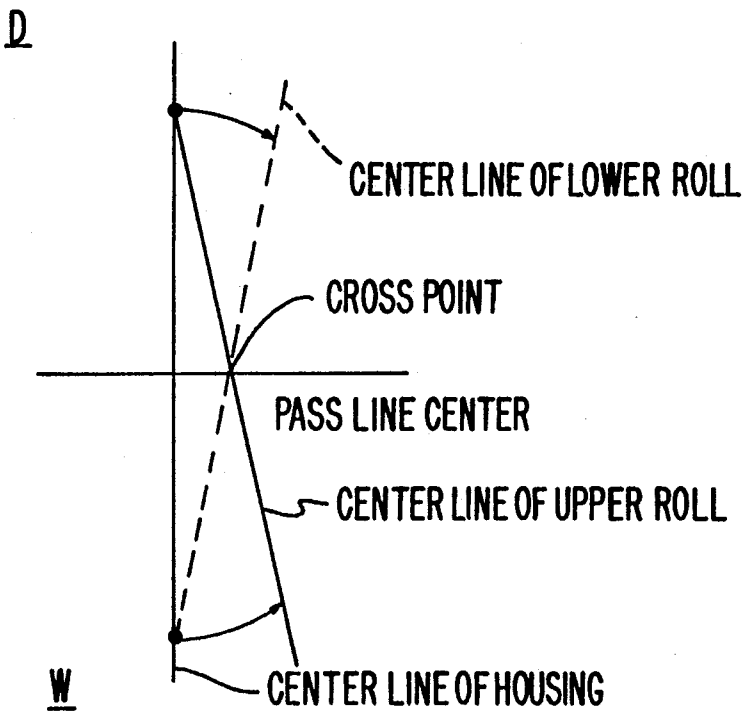
FIGS. 7(*a*) and 7(*b*) are diagrams illustrating the displacements of the rolls when only the roll ends are displaced at the drive side or the working side.
Figure 7A:
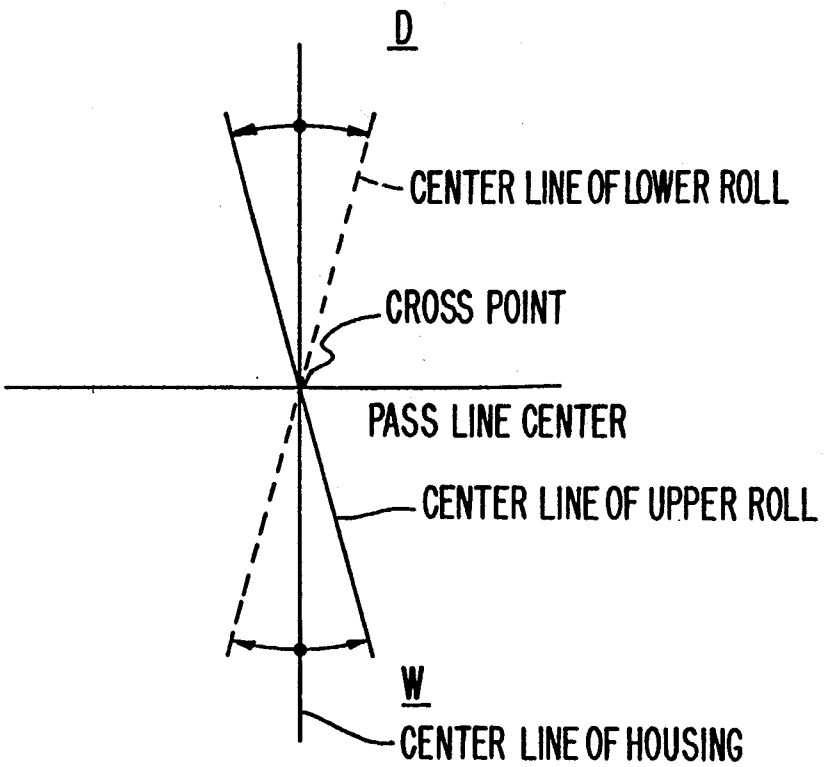

This operation is illustrated in FIG. 7. FIG. 7(*a*) illustrates the displacements of the rolls of the roll crossing apparatus at both the drive side D and the working side W, while FIG. 7(*b*) illustrates the displacements of the rolls only at the working side W while the rolls remain fixed at the drive D (the broken line shows the opposite case).

Figure 8:
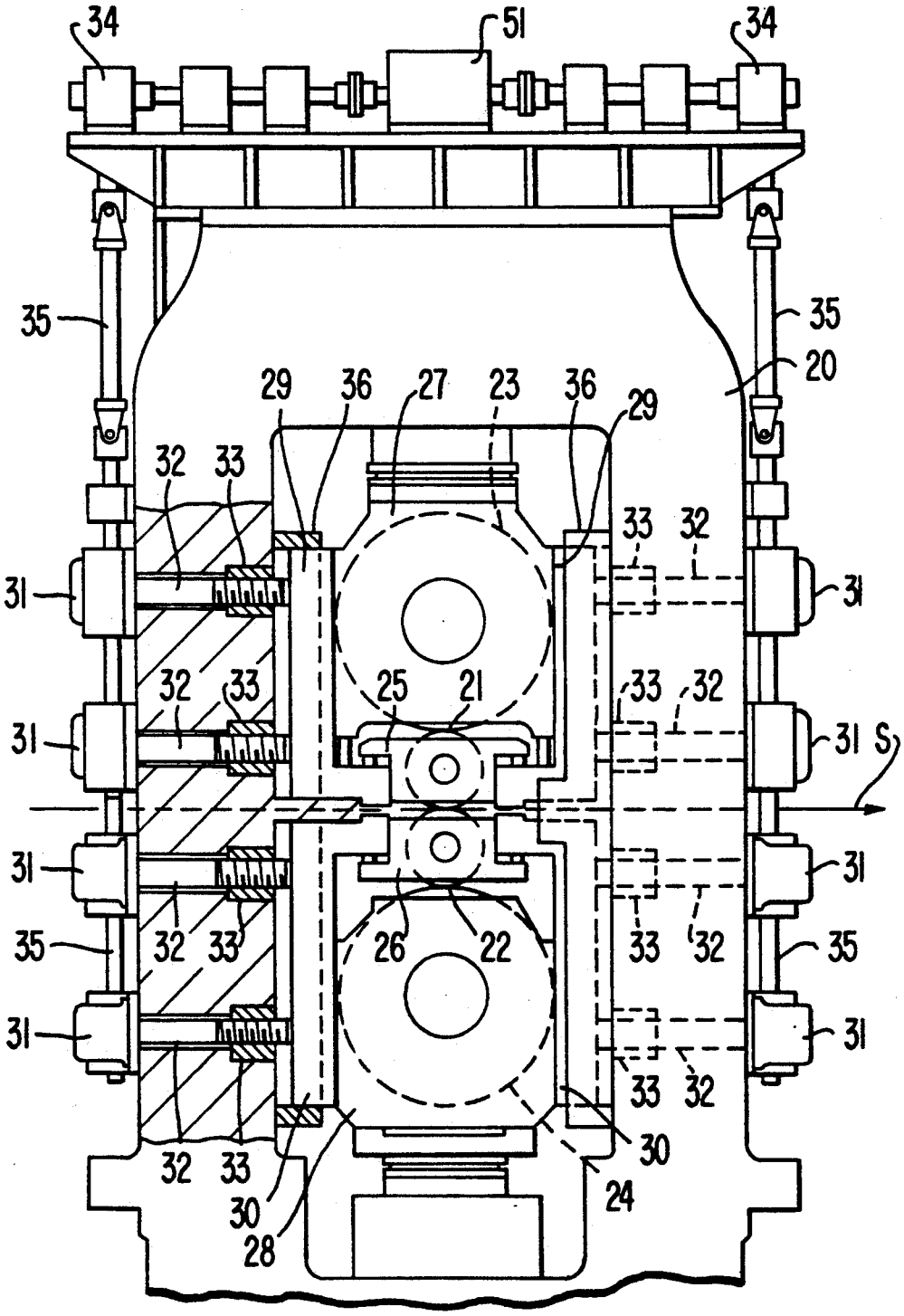
FIG. 8 (PRIOR ART)
FIG. 8 is a side elevation view of an essential portion of a cross-rolling mill of the prior art.
Figure 9:
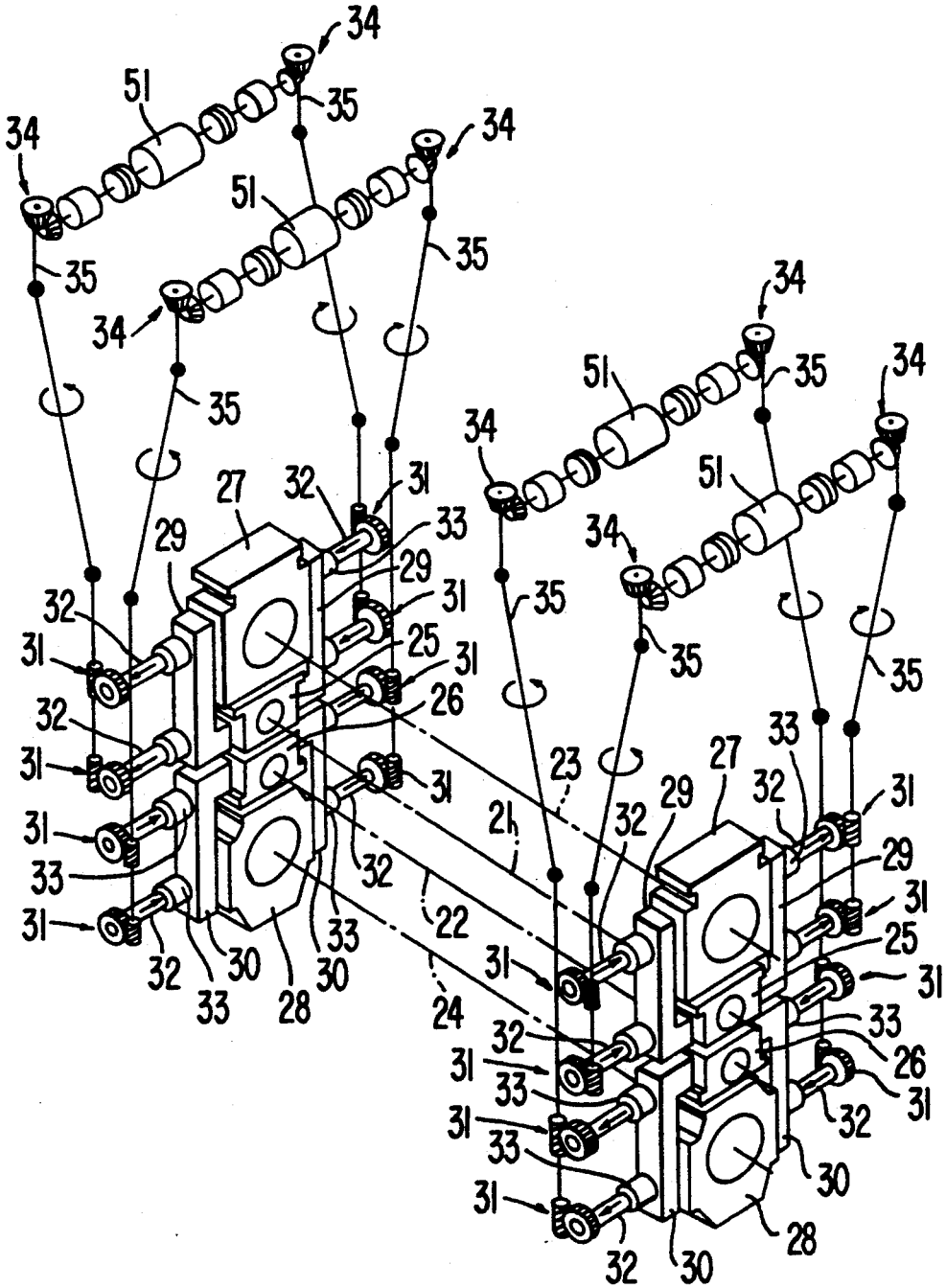
FIG. 9 (PRIOR ART)
FIG. 9 is a perspective view of a roll crossing apparatus of the mill of FIG. 8.

In the embodiments thus far described, moreover, the wedges 3 are disposed at both the entrance A and the exit B of the housing. However, according to the present invention, the wedges 3 can be disposed only at the entrance A or the exit B while at the exit or entrance (other end) the conventional arrangement shown in FIGS. 8 and 9 is adopted or the roll chocks are supported by a hydraulic cylinder.

This modification is particularly applicable to the case in which existing facilities are to be reformed.

We claim:

1. A cross-rolling mill comprising: a housing; upper and lower rolls; upper and lower roll chocks rotatably supporting said upper and lower rolls, respectively, each of said roll chocks having liners on opposite sides thereof, said liners each having an outer cylindrical surface; upper and lower cross heads supporting said upper and lower roll chocks, respectively, each of said cross heads having a cylindrical surface at an inner side thereof complementary to and in face-to-face engagement with the cylindrical surface of the liner of the roll check which the cross head supports, and each of said cross heads having a plurality of steps at a gradient with respect to a vertical line at an outer side thereof, the gradient of the steps at corresponding ones of the outer sides of the upper end and the lower cross heads being opposite to one another with respect to the vertical line; vertically movable wedges associated with said cross heads, each of said wedges having a plurality of surfaces inclined relative to the vertical line, said plurality of surfaces being in sliding engagement with a number of said plurality of steps at a said outer side of a respective one of said cross heads, vertical movement of said wedges from a given position causing said upper and said lower rolls to cross one another so that rotational axes of said rolls are skewed relative to one another; and guides mounted to said housing and engaged with said wedges so as to guide said wedges in their vertical movement.

2. A cross-rolling mill as claimed in claim 1, wherein said housing has a working side located at corresponding first axial ends of said rolls, and a drive side located at corresponding second axial ends of said rolls, each said cross head having a plurality of steps and supporting a said upper roll chock is located at only one of the working side and the drive side of the housing, and each said cross head having a plurality of steps and supporting a said lower roll chock is located at only the other of the working side and the drive side of the housing.

3. A cross-rolling mill as claimed in claim 2, wherein said upper and lower rolls include an upper work roll, an upper backup roll, a lower work roll and a lower backup roll, said roll chocks include work roll chocks rotatably supporting said work rolls, and backup roll chocks rotatably supporting said backup rolls, and each said wedge is associated with the cross heads which support both work roll and backup roll chocks such that vertical movement of one said wedge causes both backup and work rolls to displace.

4. A cross-rolling mill as claimed in claim 3, wherein said housing has inner opposing surfaces, each of said cross heads is interposed between the roll chock which the cross head supports and one of the inner opposing surfaces of the housing, said vertically movable wedges are interposed between the steps of said cross heads and a respective one of the inner opposing surfaces of said housing, said guides are interposed between said roll chocks and said housing, and said wedges are located between respective ones of said guides.

5. A cross-rolling mill as claimed in claim 3, wherein each of said guides is fixed to an outwardly facing surface of said housing, and said cross heads and said wedges are located between respective ones of said guides and said outwardly facing surfaces of said housing, said guides also being engaged with said cross heads so as to guide said cross heads when the cross heads are displaced by vertical movement of said wedges.

6. A cross-rolling mill as claimed in claim 2, wherein said housing has inner opposing surfaces, each of said cross heads is interposed between the roll chock which the cross head supports and one of the inner opposing surfaces of the housing, said vertically movable wedges are interposed between the steps of said cross heads and a respective one of the inner opposing surfaces of said housing, said guides are interposed between said roll chocks and said housing, and said wedges are located between respective ones of said guides.

7. A cross-rolling mill as claimed in claim 2, wherein each of said guides is fixed to an outwardly facing surface of said housing, and said cross heads and said wedges are located between respective ones of said guides and said outwardly facing surfaces of said housing, said guides also being engaged with said cross heads so as to guide said cross heads when the cross heads are displaced by vertical movement of said wedges.

8. A cross-rolling mill as claimed in claim 1, wherein each said wedge includes integral upper and lower portions each having a plurality of said surfaces inclined relative to the vertical, the plurality of inclined surfaces of the upper portion of each said wedge being in sliding engagement with a number of said plurality of steps of a said cross head supporting a said upper roll chock, and the plurality of inclined surfaces of the lower portion of each said wedge being in sliding engagement with a number of said plurality of steps of a said cross head supporting a said lower roll chock.

9. A cross-rolling mill as claimed in claim 8, wherein said upper and lower rolls include an upper work roll, an upper backup roll, a lower work roll and a lower backup roll, said roll chocks include work roll chocks rotatably supporting said work rolls, and backup roll chocks rotatably supporting said backup rolls, and each said wedge is associated with the cross heads which support both work roll and backup roll chocks such that vertical movement of one said wedge causes both backup and work rolls to displace.

10. A cross-rolling mill as claimed in claim 9, wherein said housing has inner opposing surfaces, each of said cross heads is interposed between the roll chock which the cross head supports and one of the inner opposing surfaces of the housing, said vertically movable wedges are interposed between the steps of said cross heads and a respective one of the inner opposing surfaces of said housing, said guides are interposed between said roll chocks and said housing, and said wedges are located between respective ones of said guides.

11. A cross-rolling mill as claimed in claim 9, wherein each of said guides is fixed to an outwardly facing surface of said housing, and said cross heads and said wedges are located between respective ones of said guides and said outwardly facing surfaces of said housing, said guides also being engaged with said cross heads so as to guide said cross heads when the cross heads are displaced by vertical movement of said wedges.

12. A cross-rolling mill as claimed in claim 8, wherein said housing has inner opposing surfaces, each of said cross heads is interposed between the roll chock which the cross head supports and one of the inner opposing surfaces of the housing, said vertically movable wedges are interposed between the steps of said cross heads and a respective one of the inner opposing surfaces of said housing, said guides are interposed between said roll chocks and said housing, and said wedges are located between respective ones of said guides.

13. A cross-rolling mill as claimed in claim 8, wherein each of said guides is fixed to an outwardly facing surface of said housing, and said cross heads and said wedges are located between respective ones of said guides and said outwardly facing surfaces of said housing, said guides also being engaged with said cross heads so as to guide said cross heads when the cross heads are displaced by vertical movement of said wedges.

14. A cross-rolling mill as claimed in claim 1, wherein said upper and lower rolls include an upper work roll, an upper backup roll, a lower work roll and a lower backup roll, said roll chocks include work roll chocks rotatably supporting said work rolls, and backup roll chocks rotatably supporting said backup rolls, and each said wedge is associated with the cross heads which support both work roll and backup roll chocks such that vertical movement of one said wedge causes both backup and work rolls to displace.

15. A cross-rolling mill as claimed in claim 14, wherein said housing has inner opposing surfaces, each of said cross heads is interposed between the roll chock which the cross head supports and one of the inner opposing surfaces of the housing, said vertically movable wedges are interposed between the steps of said cross heads and a respective one of the inner opposing surfaces of said housing, said guides are interposed between said roll chocks and said housing, and said wedges are located between respective ones of said guides.

16. A cross-rolling mill as claimed in claim 14, wherein each of said guides is fixed to an outwardly facing surface of said housing, and said cross heads and said wedges are located between respective ones of said guides and said outwardly facing surfaces of said housing, said guides also being engaged with said cross heads so as to guide said cross heads when the cross heads are displaced by vertical movement of said wedges.

17. A cross-rolling mill as claimed in claim 1, wherein said housing has inner opposing surfaces, each of said cross heads is interposed between the roll chock which the cross head supports and one of the inner opposing surfaces of the housing, said vertically movable wedges are interposed between the steps of said cross heads and a respective one of the inner opposing surfaces of said housing, said guides are interposed between said roll chocks and said housing, and said wedges are located between respective ones of said guides.

18. A cross-rolling mill as claimed in claim 1, wherein each of said guides is fixed to an outwardly facing surface of said housing, and said cross heads and said wedges are located between respective ones of said guides and said outwardly facing surfaces of said housing, said guides also being engaged with said cross heads so as to guide said cross heads when the cross heads are displaced by vertical movement of said wedges.

* * * * *